US009365381B2

(12) United States Patent
Colonel et al.

(10) Patent No.: US 9,365,381 B2
(45) Date of Patent: Jun. 14, 2016

(54) COMPACT PRINTER WITH PRINT FRAME INTERLOCK

(71) Applicant: Datamax-O'Neil Corporation, Orlando, FL (US)

(72) Inventors: Kenneth Colonel, Oviedo, FL (US); Raul Palacios, Apopka, FL (US); Ching-Yang Chou, Taipei Hsien (TW); Dick Feng Yi Tai, Taipei Hsien (TW)

(73) Assignee: Datamax-O'Neil Corporation, Orlando, FL (US)

( * ) Notice: Subject to any disclaimer, the term of this patent is extended or adjusted under 35 U.S.C. 154(b) by 369 days.

(21) Appl. No.: 13/938,399

(22) Filed: Jul. 10, 2013

(65) Prior Publication Data

US 2013/0294806 A1 Nov. 7, 2013

Related U.S. Application Data

(62) Division of application No. 12/974,456, filed on Dec. 21, 2010, now Pat. No. 8,500,351.

(51) Int. Cl.
*B65H 23/28* (2006.01)
*B41J 11/00* (2006.01)
(Continued)

(52) U.S. Cl.
CPC ..... *B65H 23/28* (2013.01); *B41J 11/0025* (2013.01); *B41J 11/34* (2013.01); *B41J 11/46* (2013.01); *B41J 15/04* (2013.01); *B41J 15/042* (2013.01); *B41J 15/046* (2013.01); *B65H 2404/55* (2013.01); *B65H 2404/611* (2013.01); *B65H 2404/741* (2013.01); *B65H 2404/743* (2013.01)

(58) Field of Classification Search
CPC ..... B41J 15/046; B41J 11/0025; B41J 17/20; B41J 17/22; B41J 17/24; B41J 17/26; B65H 23/28; B65H 2404/611; B65H 2404/55; B65H 2404/61; B65H 2404/74; B65H 2404/741; B65H 2404/743
See application file for complete search history.

(56) References Cited

U.S. PATENT DOCUMENTS 4,547,780 A 10/1985 Cummins
4,563,690 A 1/1986 Tomita et al.
(Continued)

FOREIGN PATENT DOCUMENTS

EP 1 872 958 1/2008
JP 59156786 9/1984
(Continued)

OTHER PUBLICATIONS

European Search Report Application No. 11 19 2639 dated Apr. 18, 2012 (4 pages).

*Primary Examiner* — Michael McCullough
(74) *Attorney, Agent, or Firm* — Additon, Higgins & Pendleton, P.A.

(57) ABSTRACT

A compact printer having improved operational features. The printer includes an articulating print frame assembly coupled to a top cover that is adapted to rotate out of the top cover to an open position and to rotate into the top cover to a closed position. When the print frame is in an open position, the top cover is prevented from rotating toward the bottom housing to a closed position. The print frame includes a ribbon guide bar that facilitates loading of ribbon and media. The disclosed printer also includes a fixed or adjustable media sensor, and is configurable to accommodate an internal supply of web (roll) media or an external supply of fanfold media, a bottom housing having a top cover coupled thereto.

8 Claims, 15 Drawing Sheets

(51) Int. Cl.

| | |
|---|---|
| ***B41J 11/34*** | (2006.01) |
| ***B41J 11/46*** | (2006.01) |
| ***B41J 15/04*** | (2006.01) |

(56) References Cited

U.S. PATENT DOCUMENTS

| | | | | |
|---|---|---|---|---|
| 4,642,656 | A | 2/1987 | Shibuya et al. | |
| 4,797,690 | A | 1/1989 | Takita et al. | |
| 4,812,063 | A | 3/1989 | Kunimitsu et al. | |
| 5,085,532 | A | 2/1992 | Surya et al. | |
| 5,143,461 | A | 9/1992 | Inoue et al. | |
| 5,284,396 | A | 2/1994 | Masumura et al. | |
| 5,318,368 | A | 6/1994 | Fogle et al. | |
| 5,326,182 | A | 7/1994 | Hagstrom | |
| 5,340,098 | A | 8/1994 | Gunderson | |
| 5,370,470 | A | 12/1994 | Kim | |
| 5,378,072 | A | 1/1995 | Gunderson | |
| 5,399,036 | A | 3/1995 | Yamaguchi | |
| 5,470,242 | A | 11/1995 | Cheng et al. | |
| 5,478,159 | A | 12/1995 | Schneider et al. | |
| 5,480,242 | A | 1/1996 | Gunderson | |
| 5,496,121 | A | 3/1996 | Gunderson | |
| 5,619,244 | A | 4/1997 | Manna | |
| 5,622,440 | A | 4/1997 | Yamamoto et al. | |
| 5,672,020 | A | 9/1997 | Leonard et al. | |
| 5,980,138 | A | 11/1999 | Shiozaki et al. | |
| 6,394,674 | B2 | 5/2002 | Huggins et al. | |
| 6,883,983 | B2 | 4/2005 | Kobayashi | |
| 7,042,478 | B2 | 5/2006 | Bouverie et al. | |
| 7,381,002 | B2 | 6/2008 | Sugimoto et al. | |
| 8,371,580 | B2 * | 2/2013 | Nireki | B65H 5/062 271/245 |
| 2002/0048479 | A1 | 4/2002 | Bryant et al. | |
| 2010/0289211 | A1 * | 11/2010 | Nireki | B65H 5/062 271/226 |
| 2011/0058878 | A1 | 3/2011 | Maeda et al. | |

FOREIGN PATENT DOCUMENTS

| | | |
|---|---|---|
| JP | 61064478 | 4/1986 |
| JP | 61197267 | 9/1986 |
| JP | 4292972 | 10/1992 |
| WO | WO 2009144851 | 12/2009 |

* cited by examiner

COMPACT PRINTER WITH PRINT FRAME INTERLOCK

CROSS REFERENCE TO RELATED APPLICATION

This application is a divisional of and claims priority to U.S. patent application Ser. No. 12/974,456 entitled COMPACT PRINTER WITH PRINT FRAME INTERLOCK filed on Dec. 21, 2010, the entire contents of which are being incorporated by reference herein.

BACKGROUND

The present disclosure relates to continuous feed printers, and more particularly, to a compact label or thermal printer having an articulating print frame assembly having a lockout link and a swinging ribbon guide. The disclosed printer also includes a fixed or adjustable media sensor, and is configurable to accommodate an internal supply of web (roll) media or an external supply of fanfold media.

Compact or desktop printers are often used in commercial settings, e.g., in warehouses, in industrial and manufacturing environments, by shipping services, in restaurants, in the vending and gaming industries, and in other establishments for ticket printing, asset tracking, and inventory control. Ideally, compact printers weigh only a few pounds and are small enough to be readily provisioned in a work environment without significant site preparation. Such a printer may be operatively associated with an internal or external power supply that converts line voltage to the operating voltage(s) required by the printer. The printer may additionally or alternatively include a power source, such as a disposable or rechargeable battery, and may additionally communicate with a host terminal or network connection via a wired or wireless interface, such as an RS-232, Ethernet, USB, WiFi, or optical interface.

A compact printer may utilize sheet-fed media, or, more popularly, continuous-feed media, e.g., rolls of paper, labels, tags, and the like. Compact printers commonly employ direct thermal transfer techniques, whereby thermochromic media passes over a thermal print head which selectively heats areas of the media to create a visible image. Also popular are thermal transfer printers which employ a heat-sensitive ribbon to transfer images to media.

A continuous feed printer is particularly suitable for printing onto stock material which may include, but is not necessarily limited to, labels, receipts, item labels, shelf labels/tags, ticket stubs, stickers, hang tags, price stickers, and the like. Such media may be provided in web or roll configuration, or alternatively may be provided in a fanfold configuration, whereby individual media units (e.g., sheets or tags) are joined at the corresponding edges thereof and stacked in a zigzag manner.

In the case of continuous roll media, the media may be wound around a generally tubular core which supports the roll media. The core may have a standard size, or arbitrarily-sized inner diameter. Roll media is available in a wide range of widths.

The adjacent edges of contiguous fanfold media units may include scoring or perforations to facilitate stacking and/or separation of the individual media units. Fanfold media may also be provided in a wide variety of widths.

Label printers may incorporate a media supply of self-adhesive labels adhered to a coated substrate wound in a rolled configuration. Alternatively, a media supply may include a plain paper roll suitable for ink-based, toner-based, direct thermal-based, or thermal transfer-based printing. During use, media may be drawn against a printing head, which, in turn, causes images to be created on the media stock by, e.g., impact printing (dot matrix, belt printing), by localized heating of thermochromic media (direct thermal printing), by transferring temperature-sensitive ink from a ribbon to the print media (thermal transfer printing), inkjet printing, toner-based printing, or other suitable printing methods.

Compact or thermal printers may be designed for use with one type of printing media or one particular size of print media, e.g., 2-inch label stock or 3-inch label stock. Other compact printers may be configurable to accommodate different media types and sizes. Such printers may include a media centering mechanism which is designed to accommodate roll media of varying widths and/or core diameters. The media centering mechanism may include opposing support members configured to engage the media roll core. A media centering mechanism typically includes first and second support members that are generally biased towards each other to secure the media roll. Movement of the first and second support members may be synchronized by one or more gears or belts such that, when a support member is moved a distance from the centerline of the media roll, the other support member moves a corresponding distance in the opposing direction from the centerline of the media roll.

A compact printer that readily accommodates many different media types and sizes, provides improved reliability and performance, and enables facile operation and reconfiguration by a casual user, would be a welcome advance in the state of the art.

SUMMARY

The present disclosure is directed to a compact printer. The printer includes a housing having a bottom chassis, and a hinged top cover that is operatively associated with an articulating print frame assembly contained therein. The top cover is selectively movable from a closed position, suitable for printer operation, to an open position. The open position of the top cover is suitable for the loading of media, e.g., roll media or fanfold media, and for the configuration of the printer for the desired media, e.g., adjustment or installation of media guide elements as discussed in detail herein. The print frame assembly includes supports for a transfer ribbon supply roll and a transfer ribbon take-up roll, and is pivotable from a closed position, wherein the print frame is pivoted towards the top cover, to an open position wherein the print frame swing away from the top cover to provide access to the supply ribbon support and the take-up ribbon support. A print head is operatively positioned between the supply. During use, transfer ribbon is supplied from the transfer ribbon supply roll, over a print head, and to the transfer ribbon take-up roll.

The disclosed printer includes a lockout link that cooperates with the top cover and print frame assembly that prevents the top cover from being moved from an open to a closed position when the print frame is in an open position.

The print frame includes a transverse ribbon guide bar pivotably mounted thereto. The ribbon guide includes a biasing member, e.g., a v-spring, that biases the guide bar against the ribbon to take up slack and maintain tautness along the ribbon traversal. The guide bar include a smooth, arcuate surface over which the ribbon passes and which facilitates unwavering deliver of transfer ribbon to the print head, which improves print quality and reduces the likelihood of malfunction, e.g., jams, tangles, and the like.

The disclosed printer also includes a media sensor that may be provisioned in a fixed configuration or an adjustable configuration. The disclosed printer may be additionally or alternatively be configured to accommodate an internal supply of web (roll) media, or an external supply of fanfold media. A selectively installable set of fanfold guide members are disclosed that, when installed, facilitate feeding of fanfold media in a smooth and controlled manner through the media path. To facilitate external media feeding, the disclosed printer additionally includes a media feed opening defined in the housing that is substantially aligned along a plane described by the optional guide members.

In another aspect, a compact printer in accordance with the present disclosure includes a dual wall, frame housing that provides improved strength and shock resistance. The dual wall construction includes a continuous inner frame structure adapted to support one or more internal printer components, which may include, without limitation, a printhead, a roller assembly, a drive assembly, media centering assembly, and/or a battery assembly. The inner frame is surrounded at least in part by a second, outer structure that provides additional stiffness, strength, and drop resistance. The housing includes a media access opening and a corresponding media access cover configured to facilitate the loading of media into the printer. The size of the media access opening is kept to the minimum size necessary to accommodate the media for use with the printer. By minimizing the media opening, greater space is available for the inner frame and/or the outer structure, further improving the strength, rigidity, and impact resistance of the printer.

The disclosed printer may include one or more connectors that extend from the interior of housing to the exterior. While the connector(s) may include an electrical connector, other connector types are contemplated within the scope of the present disclosure, e.g., moisture-proof connectors, fluidic connectors, security connectors (e.g., K-Slot), and the like. In embodiments, two electrical connectors are provided, wherein a first connector is adapted to couple a source of electrical power to the printer and a second connector is adapted to couple a data signal to the printer. In embodiments, the disclosed printer may include a USB connector, a serial (e.g., RS-232, RS-422, RS-485), connector, a Firewire (IEEE-1394) connector, a network (10Base-T, 100Base-TX, and 1000Base-T) connector, and/or a parallel (IEEE 1284) connector.

Also disclosed is print frame lockout mechanism. The mechanism includes an upper chassis that is pivotable about a hinge between a closed position and an open position. An arcuate friction member is disposed about the hinge and includes a notch defined therein. A print frame is pivotably coupled to the upper chassis and is movable between a closed position and an open position. The mechanism further includes a lockout link having a first end operably coupled to the print frame, and a second end having a pawl. When the print frame is in an open position, the pawl engages the notch, which, in turn, prevents the chassis from pivoting. The arcuate friction member may include one or more detents configured to support the upper chassis in a fixed position. The disclosed mechanism may additionally or alternatively include a first pin extending from the print frame assembly that is configured to engage a corresponding opening defined in an upper portion of the lockout link, a second pin extending from the upper chassis, and a slot defined in the lockout link that slidably engages the second pin.

In an embodiment, a compact printer in accordance with the present disclosure includes a bottom housing having a top cover coupled thereto. The top cover is adapted to rotate away from the bottom housing to an open position and rotate toward the bottom housing to a closed position. The compact printer includes a print frame assembly coupled to the top cover that is adapted to rotate out of the top cover to an open position and to rotate into the top cover to a closed position. When the print frame is in an open position, the top cover is prevented from rotating toward the bottom housing to a closed position. The disclosed printer may include a means for retaining the print frame assembly in a closed position, such as without limitation, a latch. The print frame includes a print head for transferring indicia onto the print media.

A media sensor may be disposed along the path of the print media (e.g., the feed patch) and in an embodiment may be adjustable along an axis transverse to the print path. In embodiments, the print frame assembly may include a ribbon guide pivotably mounted thereto by at least one side arm. The ribbon guide includes a biasing member, such as without limitation, a v-spring, that is configured to bias the ribbon guide outward from the print frame assembly. The ribbon guide may include an arcuate ribbon-contacting surface. In embodiments, the printer includes first and second media support members that are reciprocally movable along a transverse axis of the printer and configured to support roll media held therebetween. An adjustable stop selectively adjustable along a transverse axis of the printer and adapted to prevent transverse motion of a media support member may additionally be included. In embodiments, the support member may configured to operably engage a fanfold guide. An elongate opening in an outer surface of the printer may be provided to facilitate the feeding of external media into the fanfold guide.

Also disclosed is a fanfold guide that is selectively coupleable to a media support member of a compact printer. The fanfold guide includes an elongate member having a channel defined therein adapted to accept the edge of print media, wherein an end of the channel includes a flared portion. A tab is disposed on the elongate member adapted to operably engage a corresponding slot defined in the media support member, and a recess is defined in an edge of fanfold guide that is adapted to operably engage a corresponding protrusion defined in the media support member. The tab-and-recess combination promotes proper and secure alignment of the fanfold guide with the media support member.

BRIEF DESCRIPTION OF THE DRAWINGS

Various embodiments of the subject instrument are described herein with reference to the drawings wherein.

DETAILED DESCRIPTION

Figure 1:
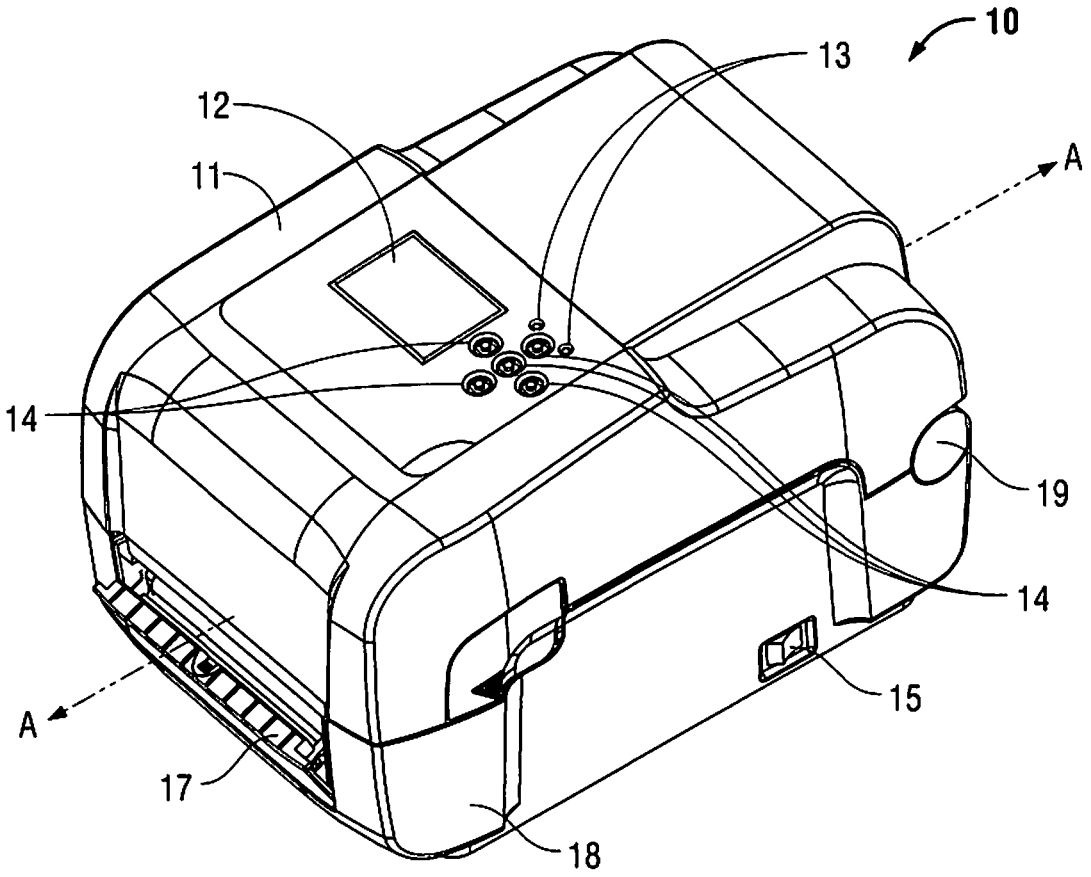
FIG. 1 is a view of an example embodiment of a compact printer in accordance with the present disclosure having a top cover in a closed position.

Particular embodiments of the present disclosure are described hereinbelow with reference to the accompanying drawings; however, it is to be understood that the disclosed embodiments are merely exemplary of the disclosure, which may be embodied in various forms. Well-known and/or repetitive functions and constructions are not described in detail to avoid obscuring the present disclosure in unnecessary or redundant detail. Therefore, specific structural and functional details disclosed herein are not to be interpreted as limiting, but merely as a basis for the claims and as a representative basis for teaching one skilled in the art to variously employ the present disclosure in virtually any appropriately detailed structure. In addition, as used herein, terms referencing orientation, e.g., "top", "bottom", "up", "down", "left", "right", "clockwise", "counterclockwise", and the like, are used for illustrative purposes with reference to the figures and features shown therein. It is to be understood that embodiments in accordance with the present disclosure may be practiced in any orientation without limitation. In this description, as well as in the drawings, like-referenced numbers represent elements which may perform the same, similar, or equivalent functions.

Figure 2:
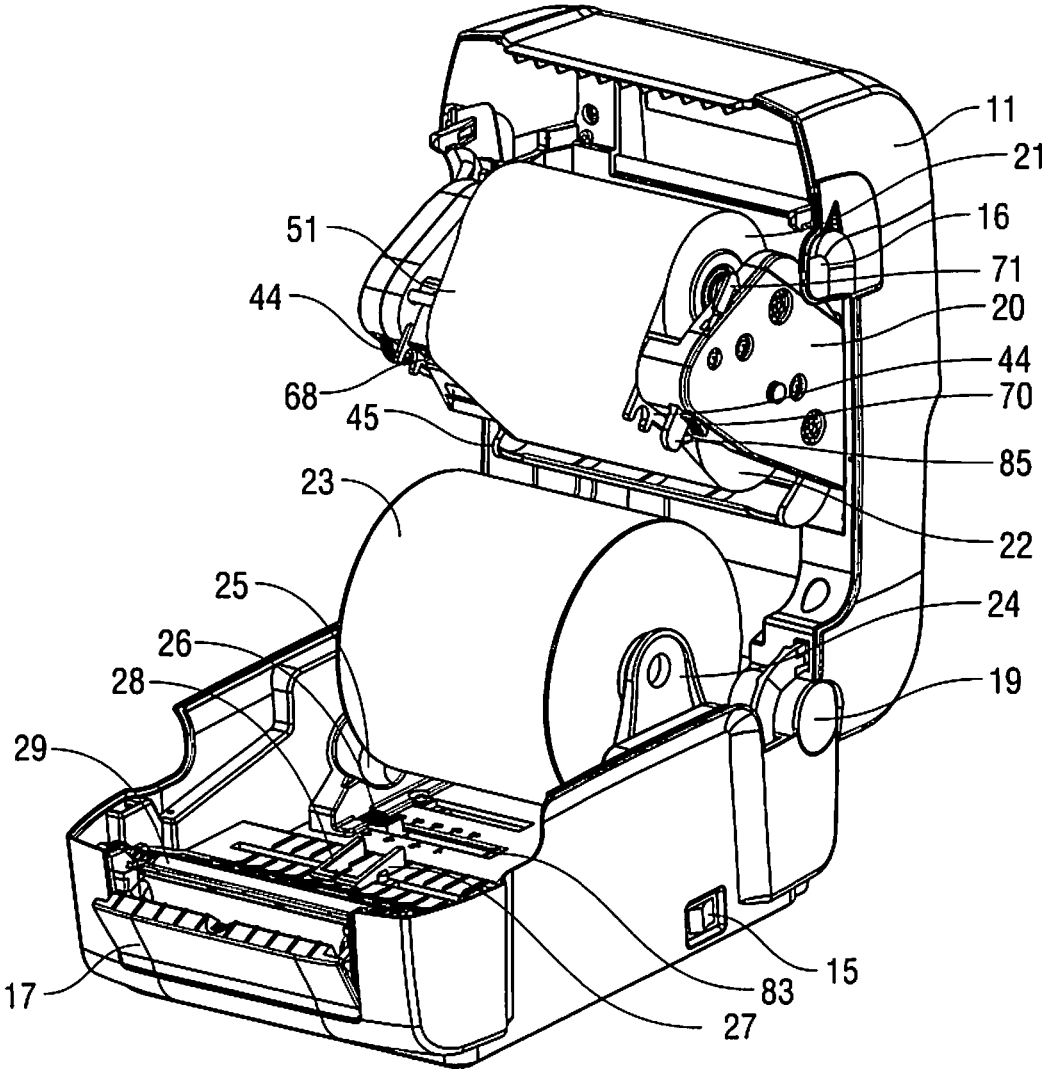
FIG. 2 is a view of the FIG. 1 embodiment of a compact printer in accordance with the present disclosure having a top cover in an open position and a print frame in an open position.

FIGS. 1 and 2 present an example embodiment of a compact printer 10 in accordance with the present disclosure. The printer 10 includes a bottom housing 18 and a selectively positionable top cover 11 that may be positioned in a closed position as shown in FIG. 1 and an open position as shown in FIG. 2. Top cover 11 and bottom housing 18 are pivotably joined by a hinge 19. Top cover 11 includes a user interface panel 12, one or more user input devices 14, and one or more indicators 13. User interface panel many be any suitable form of display panel, including without limitation an LCD screen. User input device may be any suitable form of input device, e.g., a snap dome or membrane pushbutton switch. Indicator 13 may be any suitable indication, such as without limitation a light-emitting diode (LED). Indicator 13 may illuminate to indicate the status an operational parameter, e.g., power, ready, media empty, media jam, self test, and the like. Printer 10 includes a power switch 15. A pair of latches 16 are disposed on either side of top cover 11 to retain top cover 11 in a closed position, and may be disengaged using finger pressure to facilitate opening of top cover 11. A media door 17 provides an alternative point of egress for media, which may be advantageous with self adhesive labels whereby the labels peel away from the substrate upon exiting the printer.

Figure 2A:
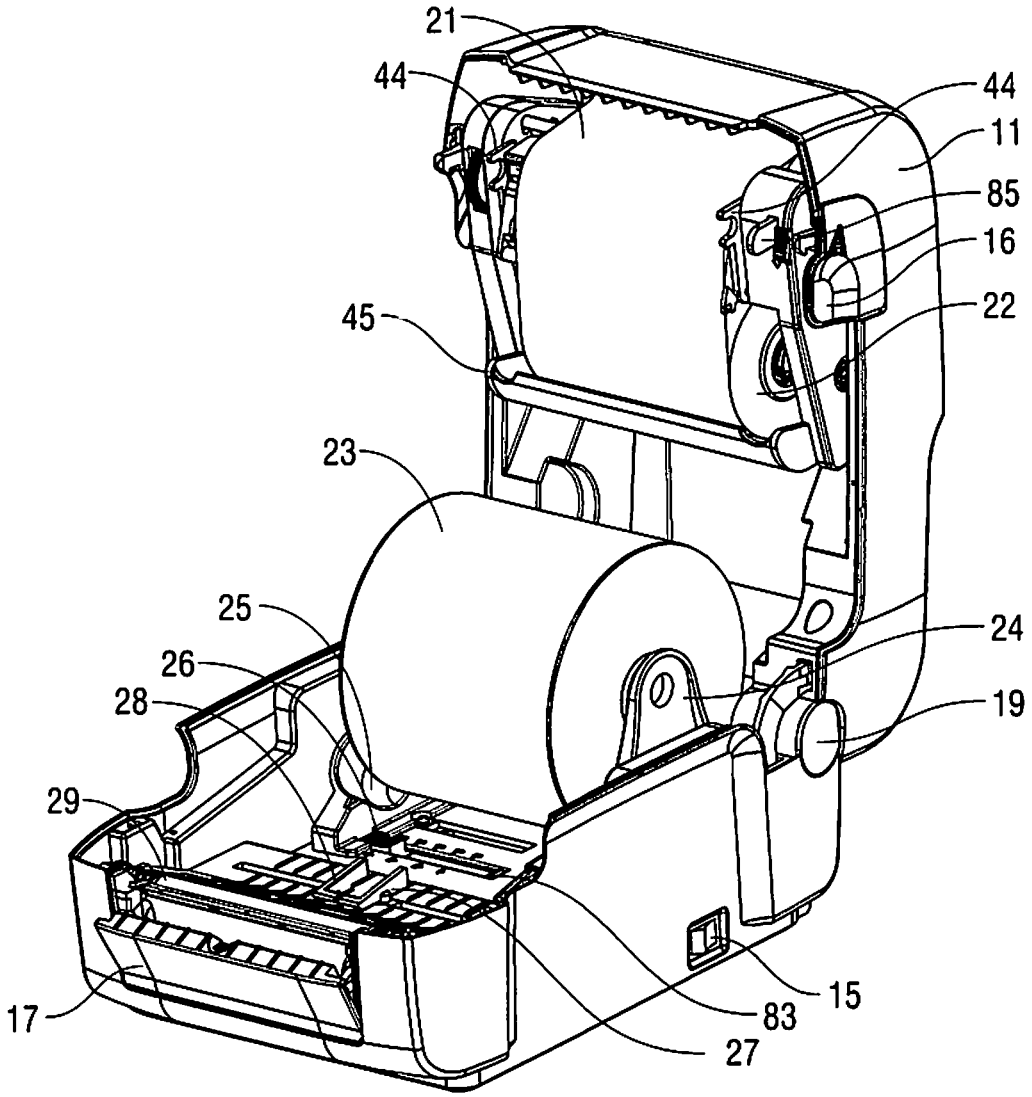
FIG. 2A is a view of the FIG. 1 embodiment of a compact printer in accordance with the present disclosure having a top cover in an open position and a print frame in a closed position.
Figure 3:
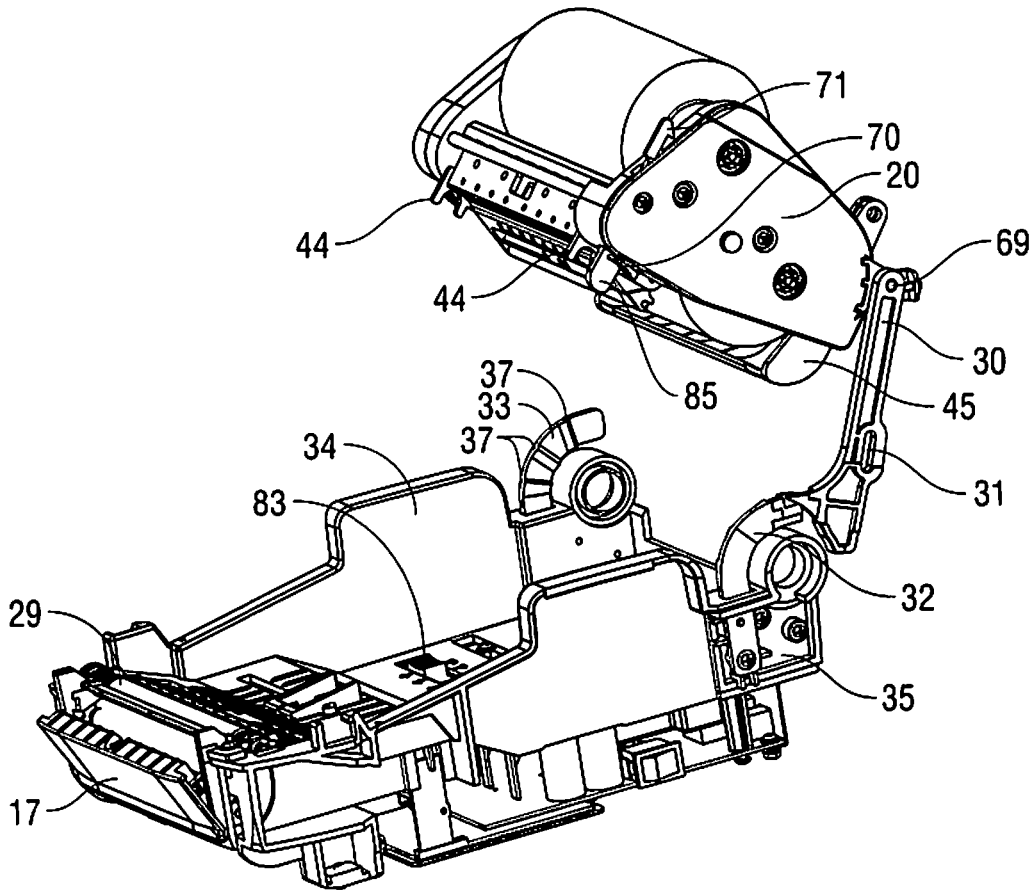
FIG. 3 is a view of print frame module, lower chassis, and a lockout link of an example embodiment of a compact printer in accordance with the present disclosure.
Figure 4:
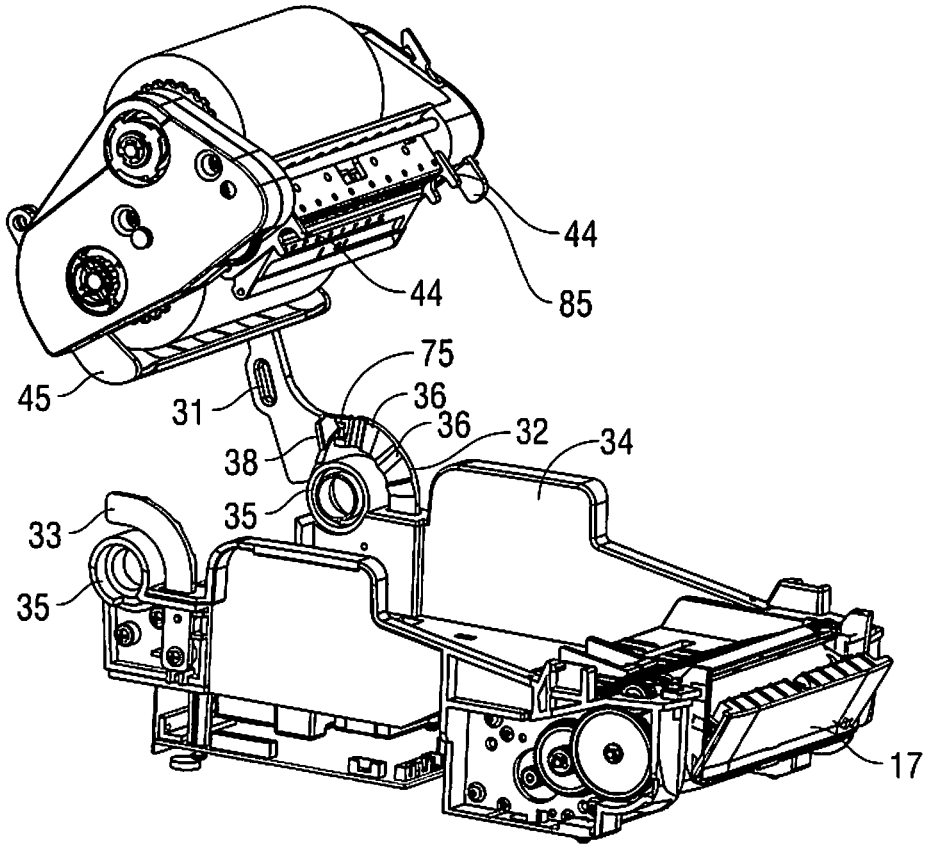
FIG. 4 is an alternative view of the FIG. 3, print frame module, lower chassis, and lockout link.

With regard to FIGS. 2 and 2A, top cover 11 includes a print frame assembly 20 pivotably mounted therein. Print frame assembly 20 includes a ribbon supply roll 22 and a ribbon take up roll 21 that are arranged to supply transfer ribbon 51 across a print head 68. Print frame assembly 20 is selectively positionable between an open position as shown in FIG. 2 and a closed position as shown in FIG. 2A. Print frame assembly 20 includes a latch 71 that engages a retaining pin (not explicitly shown) provided within top housing 11 to retain print frame assembly 20 in a closed position. A release 70 is operatively associated with latch 71 that, when depressed, releases latch 71 from the retaining pin to enable print frame assembly 20 to swing outward to an open position.

Printer 10 includes a first and a second media support members 24, 25, respectively, that are configured to support roll media 23 held therebetween. Media support members 24 and 25 are moveable along a transverse axis and are operatively associated with a reciprocal movement mechanism (not explicitly shown) that is configured to translate a transverse movement of first media support member 24 into a corresponding opposite transverse movement of second media support member 25, and vice versa. By this arrangement, roll media 23 of arbitrary width may be accommodated while concurrently centering roll media 23 with respect to the longitudinal axis "A-A" of the print head 68 and thus to the centerline of a feed path 76 corresponding thereto. First and a second media support members 24, 25 may be biased inwardly, e.g., toward the centerline, by a biasing member, e.g., a spring (not explicitly shown), to aid in gripping media roll 23 between the support members 24, 25. A selectively adjustable stop 26 enables the position of media support members 24, 25 to be preset. Stop 26 is slidably disposed within an elongate slot 83 transversely defined in feed path 76 of lower chassis 34. Stop 26 and elongate slot 83 are configured to provide sufficient friction therebetween to enable stop 26, when positioned, to overcome the inward biasing force of media support members 24, 25 and maintain media support members 24, 25 in the desired position.

A first media guide member 27 and a second media guide member 28 are moveable along a transverse axis and are operatively associated with a second reciprocal movement mechanism (not explicitly shown) that is configured to translate a transverse movement of first media guide member 27 into a corresponding opposite transverse movement of second media support member 28, and vice versa. A platen roller 29 opposes print head 68 when top cover 11 is in the closed position to ensure intimate contact between print head 68, transfer ribbon 51, and media 23 during use, which, in turn, promotes consistent high print quality. Print head 68 includes pair of saddles 44 that engage a portion of platen roller 29 to ensure precise alignment between print head 68 and platen roller 29 when top cover 11 is in a closed position.

Turning now to FIGS. 3, 4, 5, and 5A, printer 10 includes a lockout link 30 that prevents closure of the top cover 11 when print frame assembly 20 is in an open position. An upper chassis 39 is provided within top cover 11. Print frame assembly 20 is pivotably joined to upper chassis 39 by a pair of pivots 72. A pair of arcuate friction members 32, 33 are disposed about hinge 19. A series of detents 36 on friction member 32, and a series of detents 37 on friction member 33 engages corresponding slots 73, 74, respectively, in upper chassis 39, which facilitates the positioning of top cover 11 in a fully open position, a fully closed position, and several intermediate positions therebetween.

Figure 5:
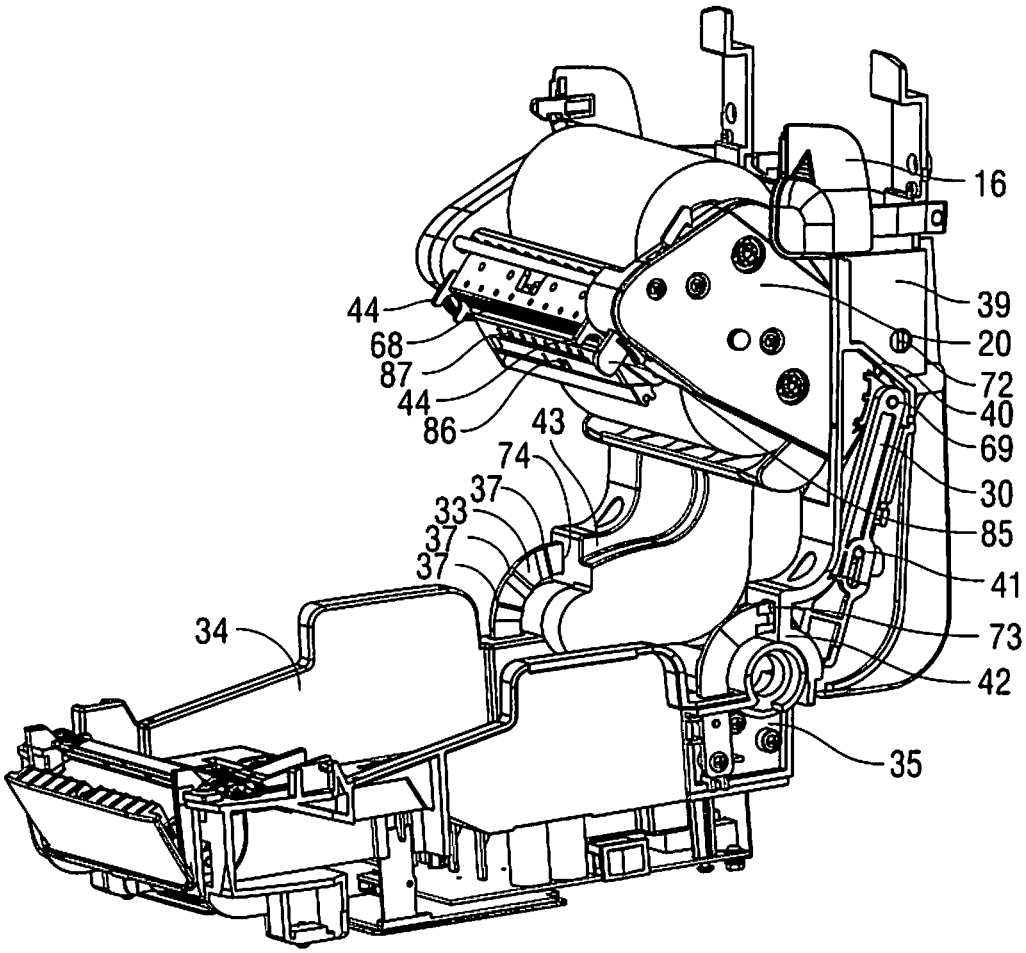
FIG. 5 illustrates a print frame module and lockout link in an open position in accordance with the present disclosure.
Figure 5A:
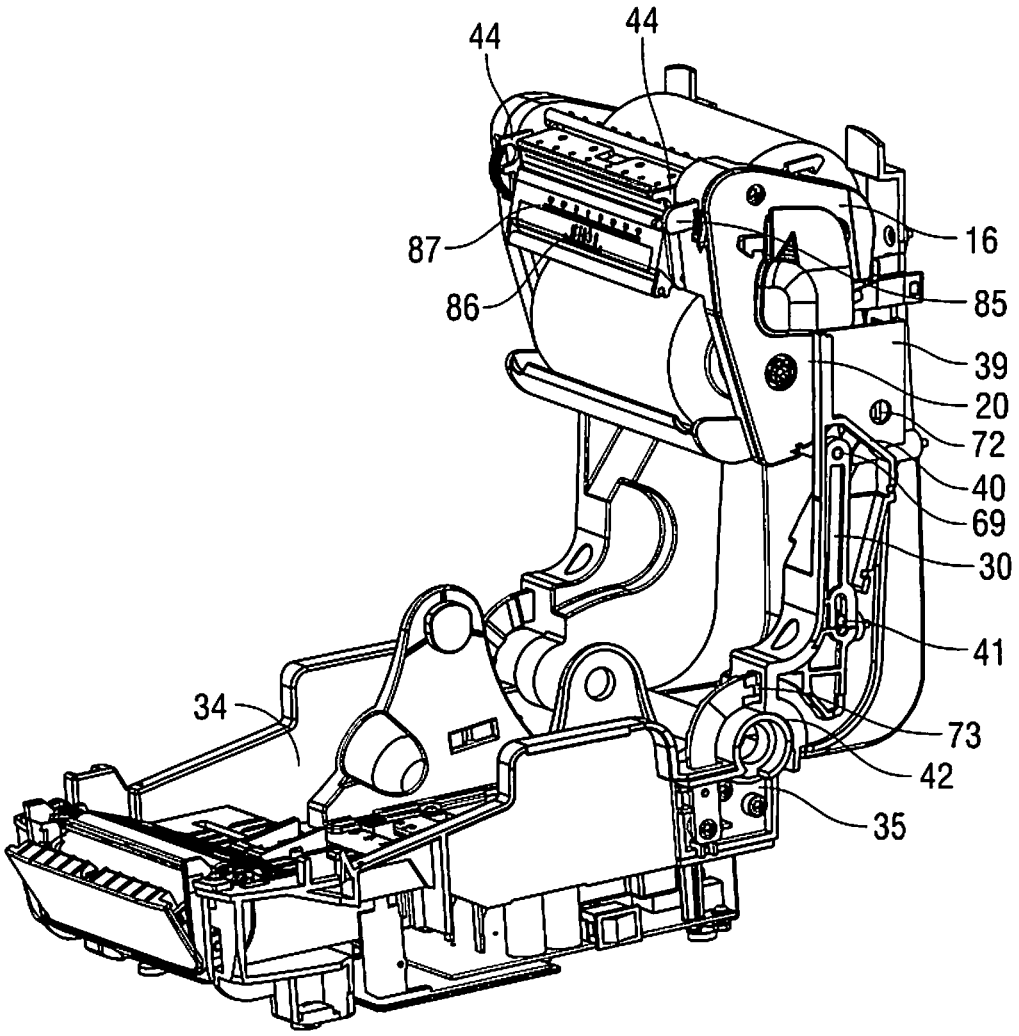
FIG. 5A illustrates a print frame module and lockout link in a closed position in accordance with the present disclosure.

As best seen in FIGS. 5 and 5A, lockout link 30 is configured to prevent closure of the top cover 11 when print frame assembly 20 is in an open position. Print frame assembly 20 includes a pin 69 operably coupled print frame assembly 20 to an upper portion of lockout link 30. Lockout link 30 include slot 31 that slidably engages pin 41 of upper chassis 39 to facilitate the articulation of lockout link 30 when print frame 20 is moved between open and closed positions. In the open position, print frame assembly 20 is pivoted forward on pivot 72, causing the lockout link 30 to ride upward and to rotate slightly clockwise on pin 41, which, in turn, causes pawl 38 of lockout link 30 to engage notch 75 of friction member 32. In this position, i.e., when pawl 38 of lockout link 30 is engaged with notch 75, top cover 11 is prevented from moving to a closed position, e.g., top cover 11 cannot be pivoted counterclockwise.

As print frame 20 moves clockwise from an open position to a closed position, pin 69 moves upward and leftward about pivot 72, which in turn rotates lockout link 30 counterclockwise and draws lockout link 30 upward, thereby disengaging pawl 38 from notch 75 and establishing sufficient clearance between the lower portion of lockout link 30 and friction member 32 to enable top cover 11 to be moved into a closed position.

Figure 6:
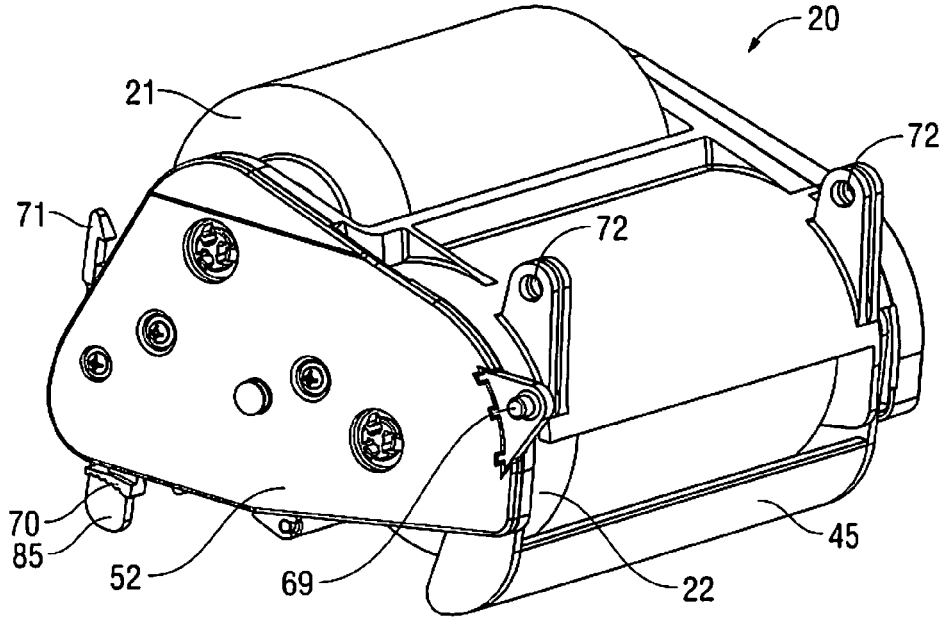
FIG. 6 is a detail view of an example print frame module of an embodiment of a compact printer in accordance with the present disclosure.
Figure 7:
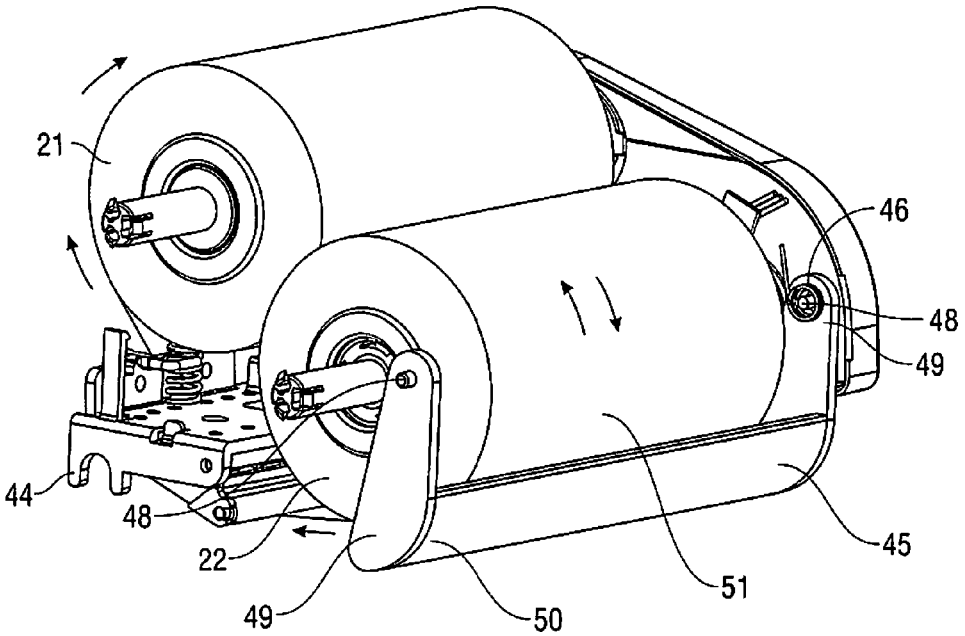
FIG. 7 is a detail view of the FIG. 6 print frame showing a ribbon guide bar in accordance with the present disclosure.
Figure 8:
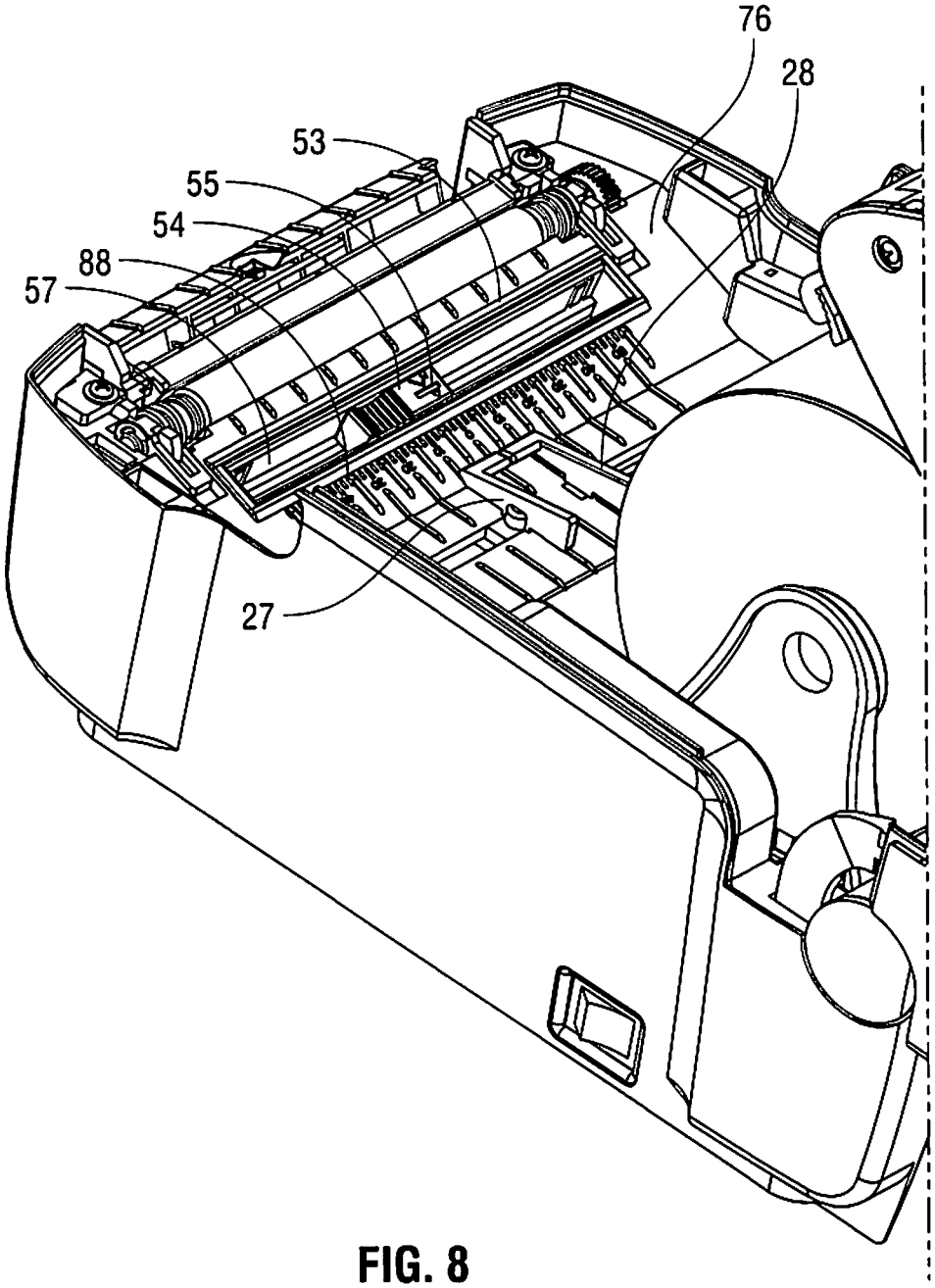
FIG. 8 is a detail view of an example embodiment of a compact printer in accordance with the present disclosure having an adjustable media sensor.
Figure 9:
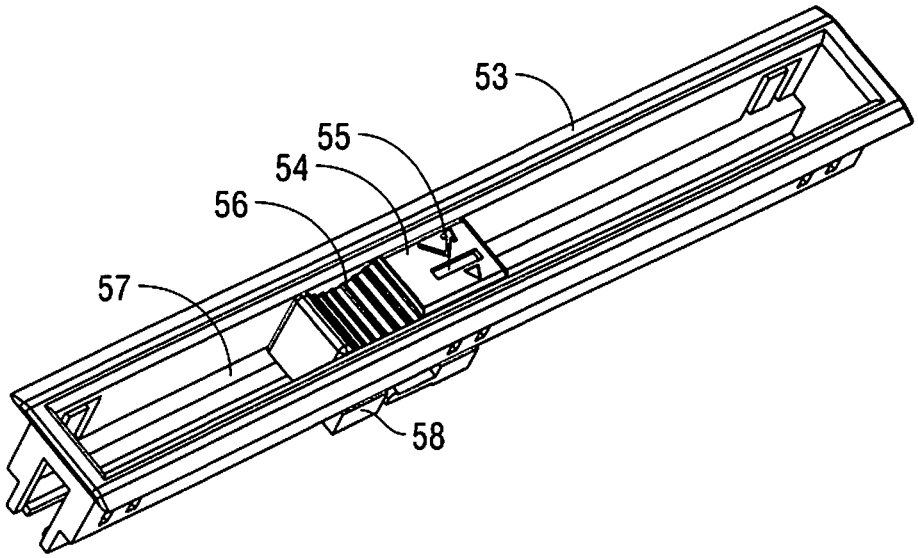
FIG. 9 is a view of an example embodiment of an adjustable media sensor assembly in accordance with the present disclosure.
Figure 10:
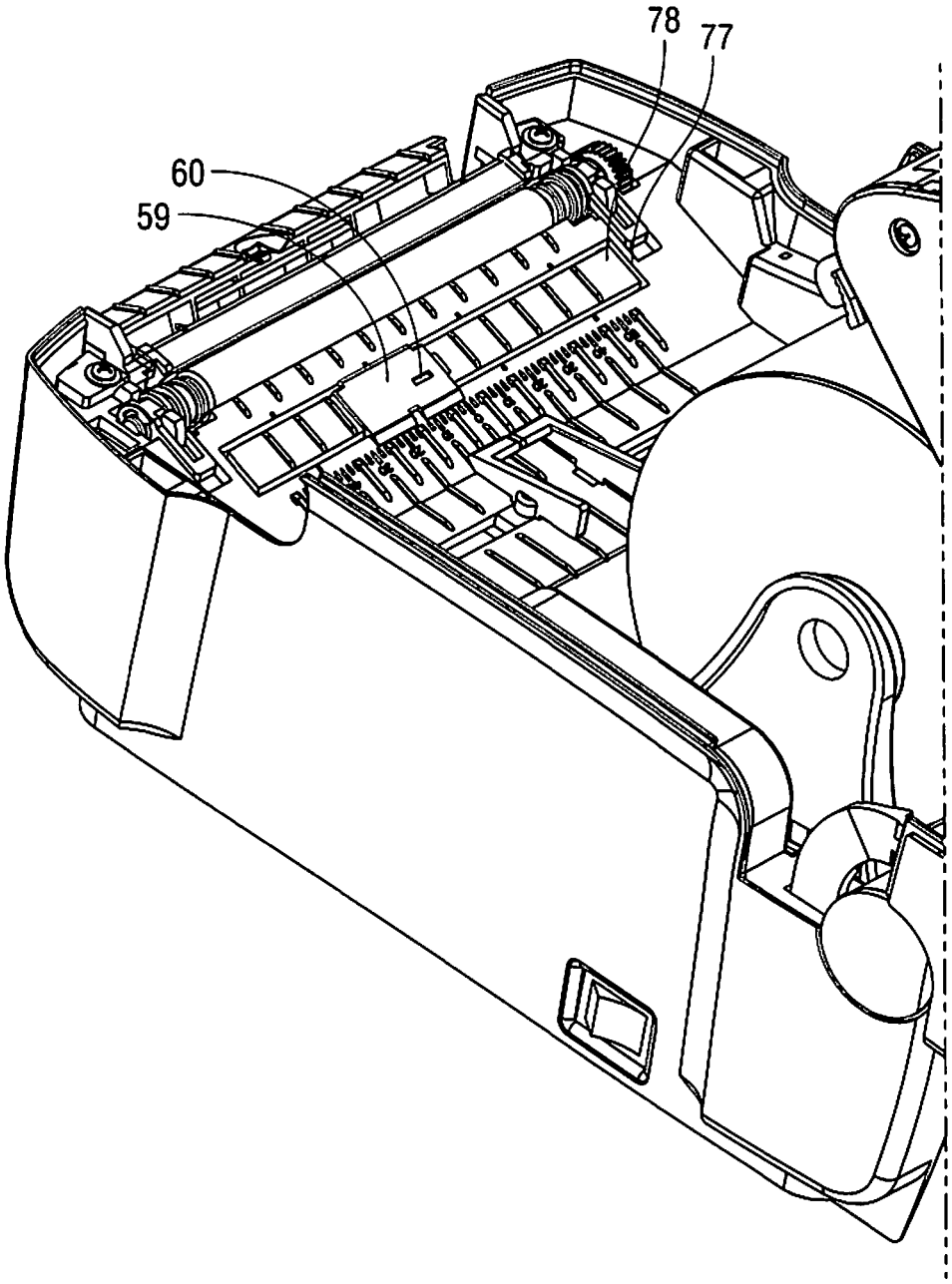
FIG. 10 is a detail view of an example embodiment of a compact printer in accordance with the present disclosure having a fixed media sensor.

Turning to FIGS. 6 and 7, print frame 20 includes transverse ribbon guide 45 pivotably mounted thereto by side arms 49. Pins 48 engage a corresponding opening (not explicitly shown) provided in a side wall 52 of print frame 20 to facilitate pivoting motion of guide bar 45. The ribbon guide 45 includes a biasing member 46, e.g., a v-spring or a leaf spring, that biases guide bar 45 outwardly from ribbon supply roll 22. During use, ribbon 51 passes over ribbon guide 45 which in turn reduces slack in ribbon 51 and maintains tautness of ribbon 51 along the traversal thereof. Guide bar 45 includes a smooth, arcuate surface 50 over which ribbon 51 passes and which promotes the steady delivery of transfer ribbon 50 over print head 68.

Printer 10 includes an adjustable media sensor assembly 53 transversely disposed in lower chassis 34 across a feed path 76. Adjustable media sensor assembly 53 includes an elongate cavity 57 having a media sensor 54 slidably disposed therein. Media sensor 54 is selectively positionable along cavity 57, which enables media sensor 54 to be aligned with index marks, media gaps, or other positional indicia characteristic of the print media, which, in turn, enables printer 10 to accurately feed and position media during use. Media sensor 54 includes an aperture 55 defined therein to enable a sensing element (not explicitly shown), such as without limitation a photodiode, to sense media indicia. In an alternative embodiment, printer 10 includes a fixed media sensor 59 having an aperture 60 defined therein to enable a sensing element (not explicitly shown), such as without limitation a photodiode, to sense media indicia therethrough. Advantageously, lower chassis 34 includes a scored opening 77 that eliminates the need for separate tooling to produce a printer 10 with an adjustable media sensor assembly 53 or a printer 10 with a fixed media sensor assembly 59. During manufacturing, a removable member 78 may be removed from scored opening 77 to provide the appropriate opening to facilitate installation of adjustable media sensor assembly 53. Alternatively during manufacture, removable member 78 may be retained and fixed media sensor 59 joined thereto.

Figure 11:
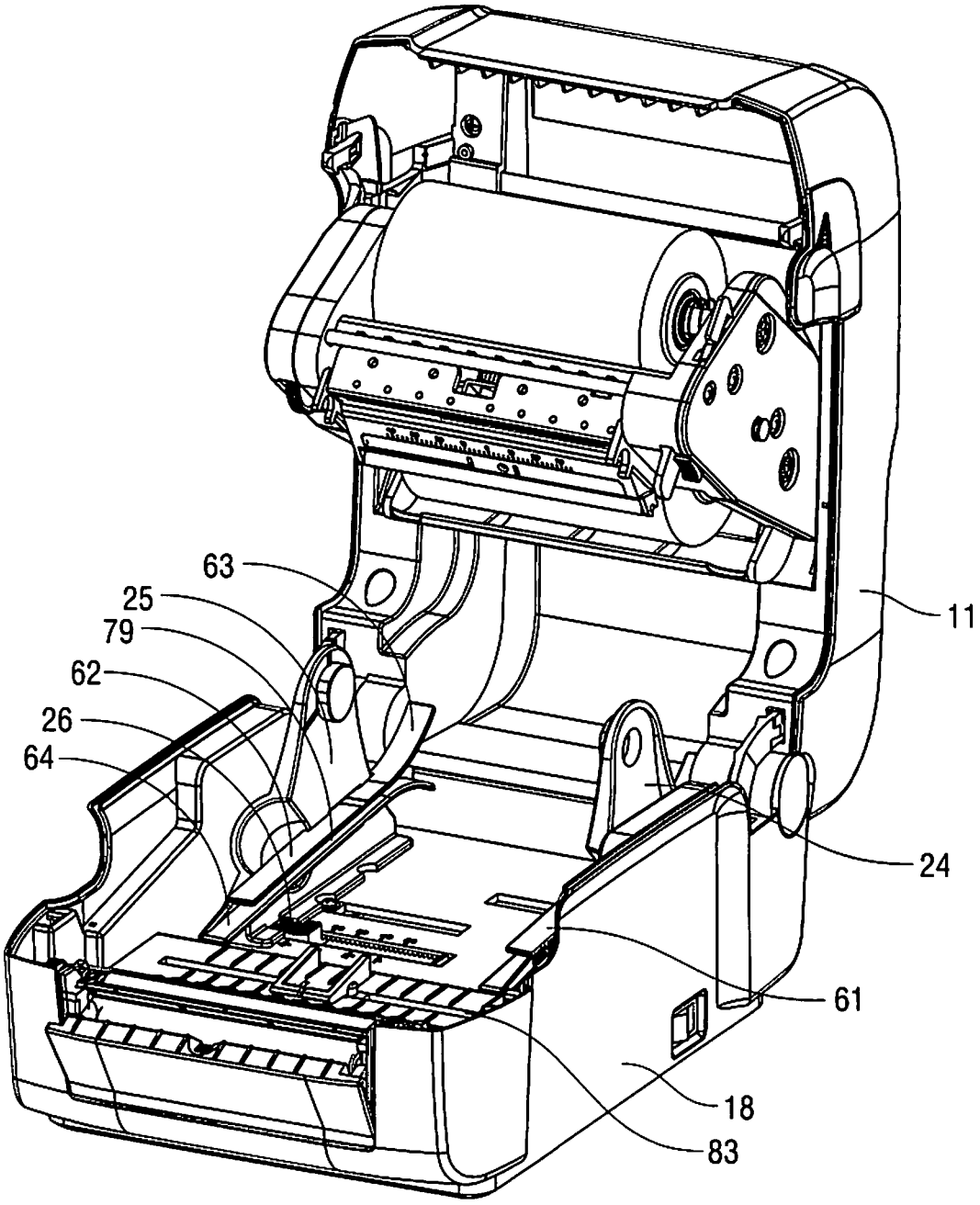
FIG. 11 is a perspective view of an example embodiment of a compact printer in accordance with the present disclosure configured with fanfold guides.
Figure 12:
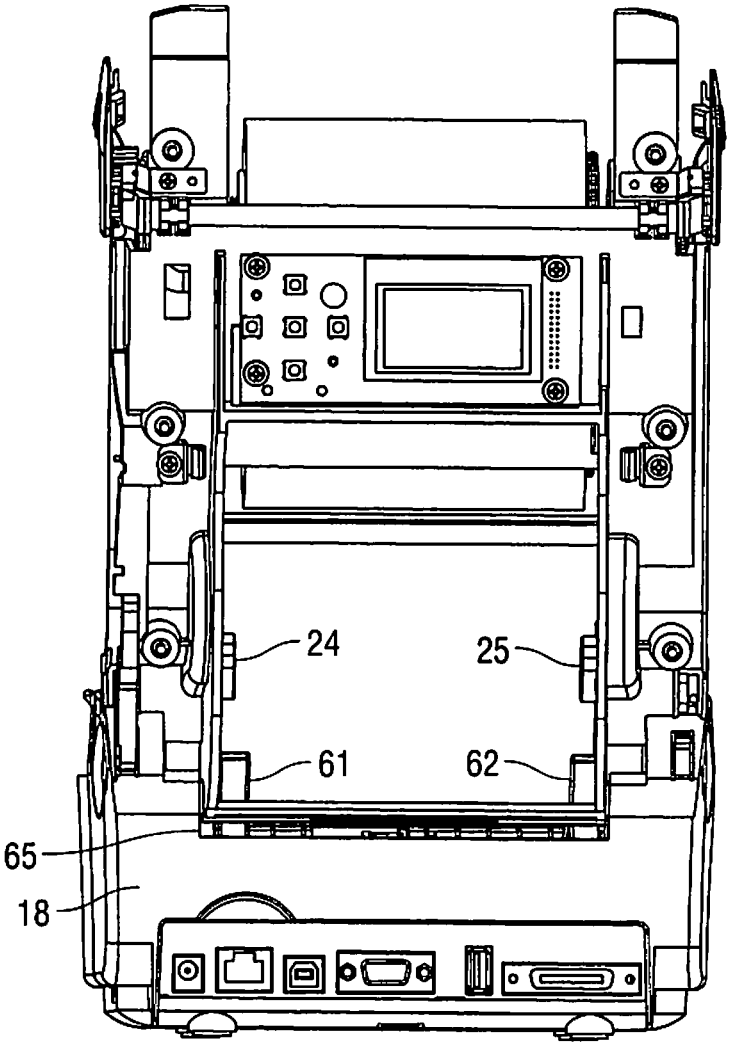
FIG. 12 is another view of the FIG. 11 example embodiment showing a relationship between a media feed opening and fanfold guides.
Figure 13:
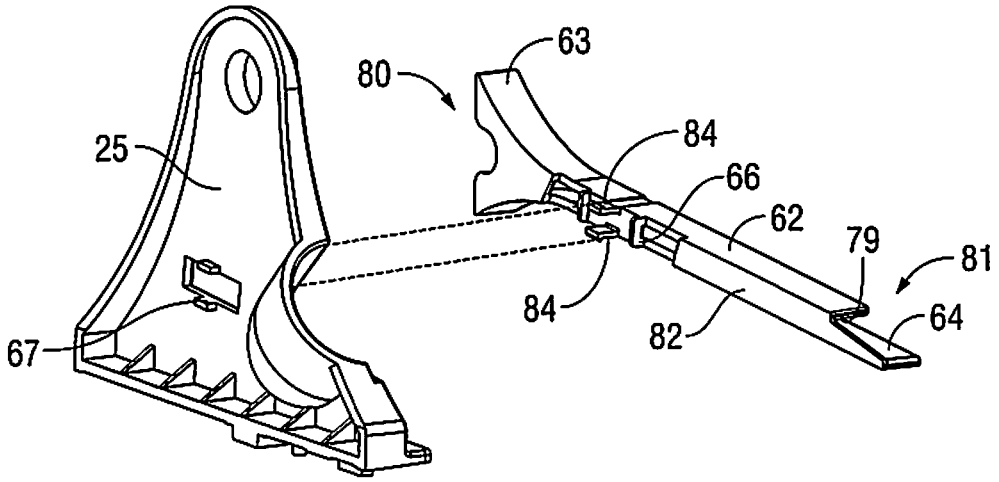
FIG. 13 is view of a media support member in relation to a removable fanfold guide.

With reference to FIGS. 11, 12, and 13, printer 10 may include a pair of fanfold guides 61, 62 that are configured to facilitate feeding non-roll media through printer 10. Fanfold guides 61, 62 may have substantially identical construction with the exception that fanfold guide 61 may be a mirror image of fanfold guide 62. Accordingly, and for the sake of brevity, the following description of fanfold guide 61 is applicable to the corresponding, reciprocal features of fanfold guide 62. Media support member 24 includes similar reciprocal features to those of media support member 25 as will be described in detail below.

Fanfold guide 61 has an elongate construction and includes a front portion 81, a rear portion 80, and a channel 79 defined therein that is adapted to accept the edge of print media during use. Rear portion 80 of channel 79 open to a flare 63 that is adapted to facilitate easy threading of media by a user. Flare 63 is aligned with an elongate media opening 65 defined in the bottom housing 18, as best seen in FIG. 12, though which media, such as without limitation fanfold media, is fed into printer 10. A lip 64 extends from the front portion 81 of fanfold guide 61 to promote a smooth and jam-free exit of media therefrom.

Fanfold guide 61 includes features designed to enable the selective coupling thereof to corresponding features provided by media support member 25. A pair of tabs 65 are disposed on fanfold guide 62 that are adapted to operably engage a corresponding slot 67 defined in media support member 65. A recess 66 is defined in a closed edge 82 of fanfold guide 61 to promote horizontal alignment of fanfold guide 61 with media support member 25 when fanfold guide 61 and media support member 25 are engaged. During use, printer 10 may be reconfigured from a roll media configuration to a fanfold or external media configuration by removing media roll 23, if present, and attaching fanfold guides 61, 62 to media support members 24, 25. Media support members 24, 25 may additionally be adjusted for width as described hereinabove, and retained in place by slidably adjusting stop 26, as needed.

The described embodiments of the present disclosure are intended to be illustrative rather than restrictive, and are not intended to represent every embodiment of the present disclosure. Further variations of the above-disclosed embodiments and other features and functions, or alternatives thereof, may be made or desirably combined into many other different systems or applications without departing from the spirit or scope of the disclosure as set forth in the following claims both literally and in equivalents recognized in law.

What is claimed is:

1. A compact printer, comprising:

a media support member having a first tab receiving slot, and a recess engaging protrusion; and a fanfold guide having an elongate member having an inward facing side with a media edge receiving channel, and an opposite outward facing edge, a first tab disposed on the outward facing edge and being complementarily shaped to the first tab receiving slot, and a recess positioned on the outward facing edge and proximate to the first tab.

2. The compact printer according to claim 1, where the media edge receiving channel of the fanfold guide includes a front portion and a rear portion, the rear portion having a flared configuration to facilitate threading print media therethrough.

3. The compact printer according to claim 2, wherein the flared rear portion is configured to align with an elongate media opening defined at the bottom of the compact printer when the fanfold guide is coupled with the media support member.

4. The compact printer according to claim 2, wherein the front portion of the fanfold guide includes a lip that extends therefrom, the lip being configured to facilitate the jam free exit of print media therefrom.

5. The compact printer according to claim 1, further comprising a second tab disposed on the fanfold guide, the second tab being configured to cooperate with the first tab to operably engage the slot defined in the media support member.

6. A compact printer comprising:

a media support member having a first tab receiving slot, and a recess engaging protrusion; and a fanfold guide having an elongate member having a media receiving end, an inward facing side with a media edge receiving channel that flares outward at the media receiving end, and an opposite outward facing edge, a first tab disposed on the outward facing edge and being complementarily shaped to the first tab receiving slot, and a recess positioned on the outward facing edge proximate to the first tab, and horizontally aligning the elongate member with the media support member when the first tab is positioned in the first tab receiving slot.

7. The compact printer according to claim 6, wherein a width of the media support member is selectively adjustable to accommodate differently-sized print media widths.

8. The compact printer according to claim 7, wherein the width of the media support member is secured at a set width by an adjustable stop.

* * * * *